US006584784B2

(12) United States Patent
Gaul

(10) Patent No.: US 6,584,784 B2
(45) Date of Patent: Jul. 1, 2003

(54) COMBINED REFRIGERATION SYSTEM WITH A LIQUID PRE-COOLING HEAT EXCHANGER

(75) Inventor: Christopher J. Gaul, Thornton, CO (US)

(73) Assignee: Midwest Research Institute, Kansas City, MO (US)

( * ) Notice: Subject to any disclaimer, the term of this patent is extended or adjusted under 35 U.S.C. 154(b) by 0 days.

(21) Appl. No.: 09/783,503

(22) Filed: Feb. 13, 2001

(65) Prior Publication Data

US 2001/0029747 A1 Oct. 18, 2001

Related U.S. Application Data

(63) Continuation-in-part of application No. 09/246,080, filed on Feb. 5, 1999, now Pat. No. 6,185,944.

(51) Int. Cl.[7] ..... F25B 41/00; F25B 1/00

(52) U.S. Cl. ..... 62/113; 62/513; 62/DIG. 2

(58) Field of Search ..... 62/DIG. 2, DIG. 17, 62/513, 113

(56) References Cited

U.S. PATENT DOCUMENTS 4,123,919 A * 11/1978 Fehlhaber ..... 62/DIG. 2
4,936,113 A * 6/1990 Nivens ..... 62/513
5,341,649 A * 8/1994 Nevitt et al. ..... 62/DIG. 2
5,457,964 A * 10/1995 Hyde ..... 62/DIG. 2
5,694,780 A * 12/1997 Alsenz ..... 62/DIG. 2
6,185,944 B1 * 2/2001 Gaul ..... 62/DIG. 2

* cited by examiner

*Primary Examiner*—William Wayner
(74) *Attorney, Agent, or Firm*—Paul J. White

(57) ABSTRACT

A compressor-pump unit for use in a vapor-compression refrigeration system is provided. The compressor-pump unit comprises a driving device including a rotatable shaft. A compressor is coupled with a first portion of the shaft for compressing gaseous refrigerant within the vapor-compression refrigeration system. A liquid pump is coupled with a second portion of the shaft for receiving liquid refrigerant having a first pressure and for discharging the received liquid refrigerant at a second pressure with the second pressure being higher than the first pressure by a predetermined amount such that the discharged liquid refrigerant is subcooled. A pre-cooling circuit is connected to the liquid pump with the pre-cooling circuit being exposed to the gaseous refrigerant whereby the gaseous refrigerant absorbs heat from the liquid refrigerant, prior to the liquid refrigerant entering the liquid pump.

23 Claims, 6 Drawing Sheets

COMBINED REFRIGERATION SYSTEM WITH A LIQUID PRE-COOLING HEAT EXCHANGER

The present application is a continuation-in-part of pending patent application Ser. No. 09/246,080, filed on Feb. 5, 1999 is now U.S. Pat. No. 6,185,944, entitled "Refrigeration System with a Compressor-Pump Unit and a Liquid-Injection Desuperheating Line".

CONTRACTUAL ORIGIN OF THE INVENTION

The United States Government has rights in this invention under Contract No. DE-AC36-99CH10093 between the United States Department of Energy and the National Renewable Energy Laboratory, a Division of the Midwest Research Institute.

BACKGROUND OF THE INVENTION

1. Field of the Invention

The present invention relates generally to vapor-compression refrigeration systems and more particularly to refrigeration systems having a refrigeration compressor and liquid refrigerant pump with a liquid pre-cooling heat exchanger to suppress flash gas bubbles at the pump inlet port.

2. Description of the Prior Art

In the United States and other countries, refrigeration systems are important for providing cooling in buildings and automobiles and in enabling safe and inexpensive food storage and transportation. The importance and number of refrigeration systems are continuing to grow with further industrialization and urbanization and as the growing population increases the demand for housing, automobiles, refrigerators, and similar products. The main purpose of a refrigeration system is to cool an enclosed space or medium to a lower temperature and to discharge absorbed heat into a higher temperature medium, such as air outside the enclosed space or other medium. To accomplish this type of cooling, it is necessary to do work on a refrigerant, such as ammonia or a halocarbon, to "pump" heat absorbed from the space being cooled into the higher temperature space.

In this regard, the most widely used refrigeration systems are compressor-driven (i.e., vapor-compression) refrigeration systems in which a compressor performs the work on the refrigerant. In typical vapor-compression refrigeration systems, cooling is achieved by passing a refrigerant through the following four basic components: an evaporator, a compressor, a condenser, and an expansion device or a valve. During operation, high pressure liquid refrigerant from the condenser passes through the expansion device, which reduces the pressure and the temperature of the liquid refrigerant. This low pressure, low temperature liquid refrigerant flows through the evaporator and evaporates as the refrigerant absorbs heat from air or liquids passing through or in heat exchange contact with the evaporator. The gaseous refrigerant is then drawn out of the evaporator by the compressor, which pumps the gaseous refrigerant to the condenser by raising the refrigerant pressure, and thus the refrigerant temperature. The gaseous refrigerant condenses to a liquid in the condenser as it gives up heat to a cooling medium that is passed through or in heat exchange contact with the condenser. The liquid refrigerant then flows to the expansion device where the cooling cycle begins again.

The efficiency or coefficient of performance (COP) of the vapor-compression refrigeration cycle can be measured as the ratio of heat absorbed in the lower temperature area to the amount of work that is put into the system, which, for the above system, would be the amount of energy required to operate the compressor.

While effective in providing cooling, a continuing concern with vapor-compression refrigeration systems has been the cost to initially purchase, to maintain, and to operate these refrigeration systems. A key component of the operating costs is the cost of energy for operating or driving the compressor. The cost of energy is generally the cost of electricity, because compressors are often driven by an electric motor, although internal combustion engines, steam turbines, and other driving devices may also be employed. To control or reduce energy costs, it is desirable to maintain and, more preferably, to increase the efficiency of the refrigeration system to obtain a desired amount of cooling at lower energy input levels, i.e., less work performed by the compressor. By increasing the efficiency of the refrigeration system, maintenance costs may also be improved as components, such as the compressor, are operated at conditions and at capacities more closely matching the conditions for which the components of the refrigeration system were designed and selected. With the widespread use of these refrigeration systems, refrigeration components and refrigeration systems having enhanced efficiency would be highly desirable in reducing the operating and maintenance cost of each system as well as resulting in a very large worldwide savings in operating (i.e., energy savings) and maintenance costs.

One method of increasing refrigeration system efficiency is to maintain the cooling levels or heat absorption levels while reducing the amount of work input to the refrigeration system by the compressor and other components. Industrial refrigeration systems often use separate, stand alone liquid refrigerant pumps to reduce the amount of overall energy used to perform cooling. Some commercial systems also employ liquid refrigerant pumps, primarily to overcome piping pressure drop. These designs use liquid pumps to increase refrigerant pressure above that available from the vapor compressor or to circulate liquid refrigerant for a variety of applications. Liquid refrigerant pumps are infrequently used in non-industrial applications because designers are unfamiliar with liquid pumping methods and are reluctant to increase initial system cost, complexity, and physical size.

The high cost of the stand alone, liquid pump is the need for a durable unit that is sealable to prevent refrigerant leakage. The air conditioning and refrigeration industry is highly competitive on initial or installation costs and skeptical of non-mainstream technology, which often requires customizing of existing refrigeration systems and support equipment. Therefore, widespread adoption of liquid pumps for new refrigeration system applications and for retrofit of existing refrigeration systems will probably not occur until a lower cost implementation of this energy saving concept is discovered.

There is still a need for refrigeration system methods and apparatus which improve the operating efficiency of refrigeration systems employing a wide variety of refrigerants and equipment, such as compressors and condensers, at an acceptable initial cost and with a technical design that is acceptable to the refrigeration industry, i.e., technology that is perceived as mainstream for the refrigeration industry and that is readily useful in typical refrigeration applications.

The present invention seeks to reduce the cost, complexity, reliability, and physical space requirements for liquid refrigerant pumping by combining the several components into an integrated unit that can be used in a wide range of sizes. The invention uses one electric motor to drive a vapor compressor and liquid refrigerant pump. The several components are enclosed within a sealed pressure housing.

Pumping any liquid near its saturation temperature is always problematic, and this is particularly true with refrigerant. When liquid refrigerant exits a condenser it is at or slightly below saturated condition. When it enters the lower pressure region of a pump, the refrigerant moves above saturated conditions and gas bubbles will form in the liquid stream. These bubbles result in pump cavitation. Cavitation reduces pump effectiveness and damages pump components. Typical refrigerant pumps must maintain a minimum Net Positive Suction Head (NPSH) to prevent cavitation. Often achieving the required NPSH is impractical on a refrigeration system. However, the present invention solves this problem by incorporating a pre-cooling heat exchanger to sufficiently subcool liquid before it enters the pump to prevent gas bubble formation and cavitation.

Refrigerant flow through a system will vary under different operating conditions. A fixed speed motor will cause a driven pump to induce the same amount of energy into the liquid stream. As such, a pump will not always provide the exact desired pressure increase. To resolve this problem, the present invention has a pressure relief device added to the pump discharge to recycle excess cooled liquid flow into the pump suction. This prevents excess pressure increase where such increases would be undesirable. Furthermore, by relieving excess liquid flow back through the pre-cooling heat exchanger, liquid is further cooled until it approaches the temperature of the cold vapor stream. The resulting heat exchange lowers liquid enthalpy, increasing its ability to perform useful work in the refrigeration system. Furthermore, refrigeration evaporators typically operate at 10–15° F. of superheat to ensure dry gas entering the vapor compressor. In the present invention the heat exchange between liquid and vapor warms the vapor stream before the vapor enters the vapor compressor portion of the invention. This allows increased evaporator effectiveness by increasing the amount of liquid in the evaporator and reducing or eliminating superheat in the vapor stream between evaporator and compressor. The pre-cooler heat exchanger provides the necessary superheat to ensure dry vapor entering the vapor compressor portion of the invention.

SUMMARY

The present invention is a compressor-pump unit for use in a vapor-compression refrigeration system. The compressor-pump unit comprises a driving device including a rotatable shaft. A compressor is coupled with a first portion of the shaft for compressing gaseous refrigerant within the vapor-compression refrigeration system. A liquid pump is coupled with a second portion of the shaft for receiving liquid refrigerant having a first pressure and for discharging the received liquid refrigerant at a second pressure with the second pressure being higher than the first pressure by a predetermined amount such that the discharged liquid refrigerant is subcooled. A pre-cooling circuit is connected to the liquid pump with the pre-cooling circuit being exposed to the gaseous refrigerant whereby the gaseous refrigerant absorbs heat from the liquid refrigerant, prior to the liquid refrigerant entering the liquid pump.

The present invention additionally includes a combined refrigeration unit having a refrigeration compressor for compressing gaseous refrigerant and a liquid refrigerant pump for receiving and discharging a liquid refrigerant. The combined refrigeration unit comprises a liquid pre-cooling heat exchanger connected to the liquid refrigerant pump and exposed to the gaseous refrigerant with the gaseous refrigerant absorbing heat from the liquid refrigerant within the liquid pre-cooling heat exchanger, prior to the liquid refrigerant entering the liquid pump.

The present invention further includes a method of enhancing the operational efficiency of a refrigeration system having a refrigeration compressor for compressing gaseous refrigerant and a liquid refrigerant pump for receiving and discharging a liquid refrigerant. The method comprises the steps of exposing the liquid refrigerant to the gaseous refrigerant prior to the liquid refrigerant entering the liquid pump.

BRIEF DESCRIPTION OF THE DRAWINGS

The accompanying drawings, which are incorporated in and form a part of the specification, illustrate the preferred embodiments of the present invention, and together with the descriptions serve to explain the principles of the invention. In the Drawings.

DETAILED DESCRIPTION OF THE PREFERRED EMBODIMENTS

Figure 1:
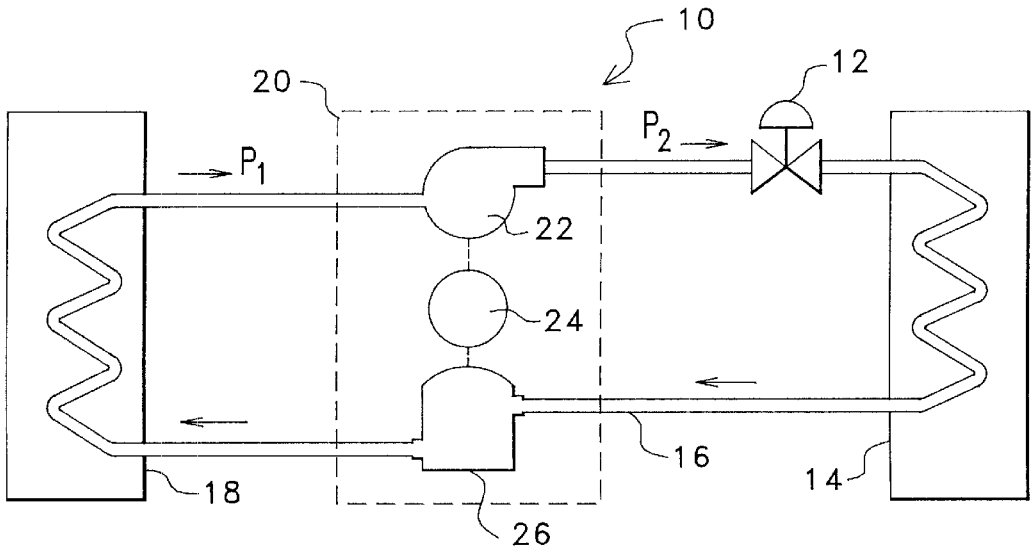
FIG. 1 is a schematic diagram of a vapor-compression refrigeration system of the present invention.

A vapor-compression refrigeration system 10 according to the present invention is illustrated schematically in FIG. 1. The refrigeration system 10 includes an expansion device 12, an evaporator 14, refrigerant piping 16 to enable refrigerant (i.e., ammonia, halocarbons, and other refrigerants suitable for vapor-compression refrigeration systems) flow, a condenser 18, and a compressor-pump unit 20 comprising a liquid pump 22, a driving device 24 and a compressor 26. To understand the inventive elements of the present invention, it is helpful to first generally understand the operation of the refrigeration system 10. During cooling operations by the refrigeration system 10, a liquid refrigerant flows through refrigerant piping 16 from the expansion device 12 to the evaporator 14 where heat is absorbed by the refrigerant causing the refrigerant to exit as a vapor or gas that is saturated or, more likely, superheated (i.e., the refrigerant absorbed more heat than required to change from a completely liquid to a completely gaseous form). Next, the low pressure, low temperature refrigerant is received by the compressor-pump unit 20 in which the compressor 26 inputs energy into the refrigerant by increasing the pressure, and concurrently, the temperature, of the refrigerant. The higher pressure, higher temperature gas is discharged from the compressor 26 of the compressor-pump unit 20 and enters the condenser 18 which removes heat from the refrigerant to take the refrigerant from a superheat state to a saturation state at which point the refrigerant vapor begins to condense. Ideally, the condenser 18 then continues to remove heat from the refrigerant to completely condense the refrigerant to a saturated liquid (i.e., liquid substantially free of vapor). The liquid refrigerant is discharged from the condenser at a condensing pressure, $P_1$, and enters the compressor-pump unit 20. The liquid pump 22 adds energy to the liquid refrigerant by increasing the liquid refrigerant pressure (i.e., liquid pressure amplification (LPA)) incrementally up to a pump discharge pressure, $P_2$. In this manner, the liquid pump 22 discharges liquid refrigerant to the expansion device 12 that is subcooled, i.e., contains more cooling potential than saturated liquid refrigerant, and the cooling operation or cycle is repeated. As may be understood by those skilled in the art, by including the liquid pump 22, the refrigeration system 10 may be operated at a lower condensing pressure, $P_1$, and a corresponding lower condensing temperature and with less work input by the compressor 26, both of which may significantly improve the efficiency of the refrigeration system 10 and reduce wear of the compressor 26.

Figure 2:
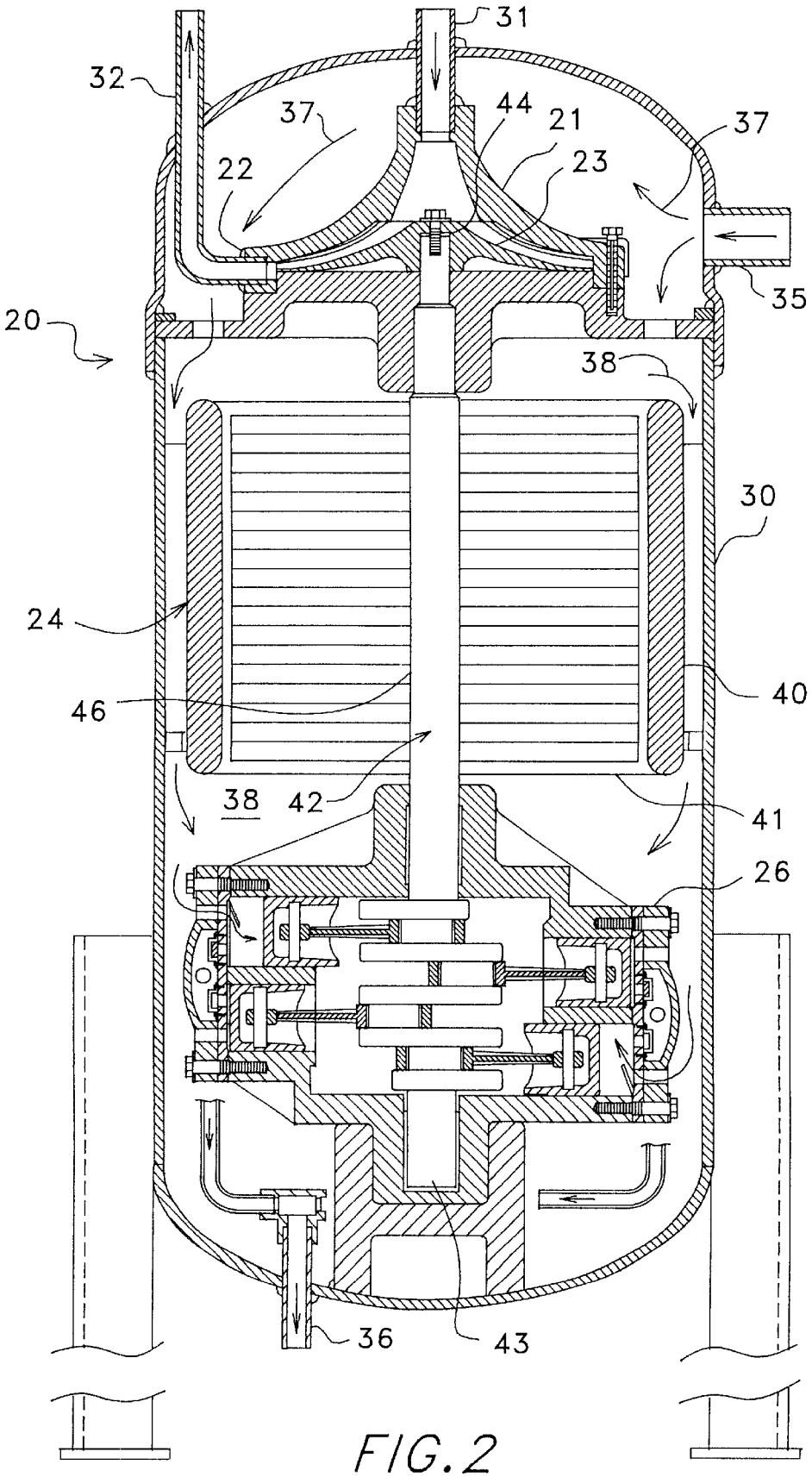
FIG. 2 is a cross-sectional view of a single housing embodiment of a compressor-pump unit of FIG. 1.

While liquid pressure amplification improves the efficiency, thus reducing operating and maintenance costs, of the refrigeration system 10, the initial cost of previous designs has been relatively high and may need to be significantly reduced for liquid pressure amplification to become widely accepted and used by the refrigeration industry. In this regard, one of the significant features of the present invention is the use of only one driving device 24 in the compressor-pump unit 20 to drive or operate both the liquid pump 22 and the compressor 26. In the past, a pump and a separate driving device, e.g., an electric motor, were employed. Such stand alone pump designs have not been widely implemented, in part, because such stand alone pump designs require expenditure not only for a pump but also for an additional driving device with corresponding containment or sealing from the refrigerant to avoid contaminating the refrigerant, as well as pump sizing and capacity synchronization and controls that are initially expensive. In contrast, as shown in FIG. 2, the compressor-pump unit 20 of the present invention provides for the operation of the liquid pump 21 and the compressor 26 with a common, single driving device 24 that does not require additional synchronization or controls. The combining of the liquid pump 21, the compressor 26, and the driving device 24 enables liquid pressure amplification to be included in refrigeration systems at a much lower initial cost than prior designs. In addition, the compressor-pump unit 20 of the present invention provides a number of other benefits, including enhanced cooling efficiency and improved space requirements, that will become clear from the following description.

Figure 3:
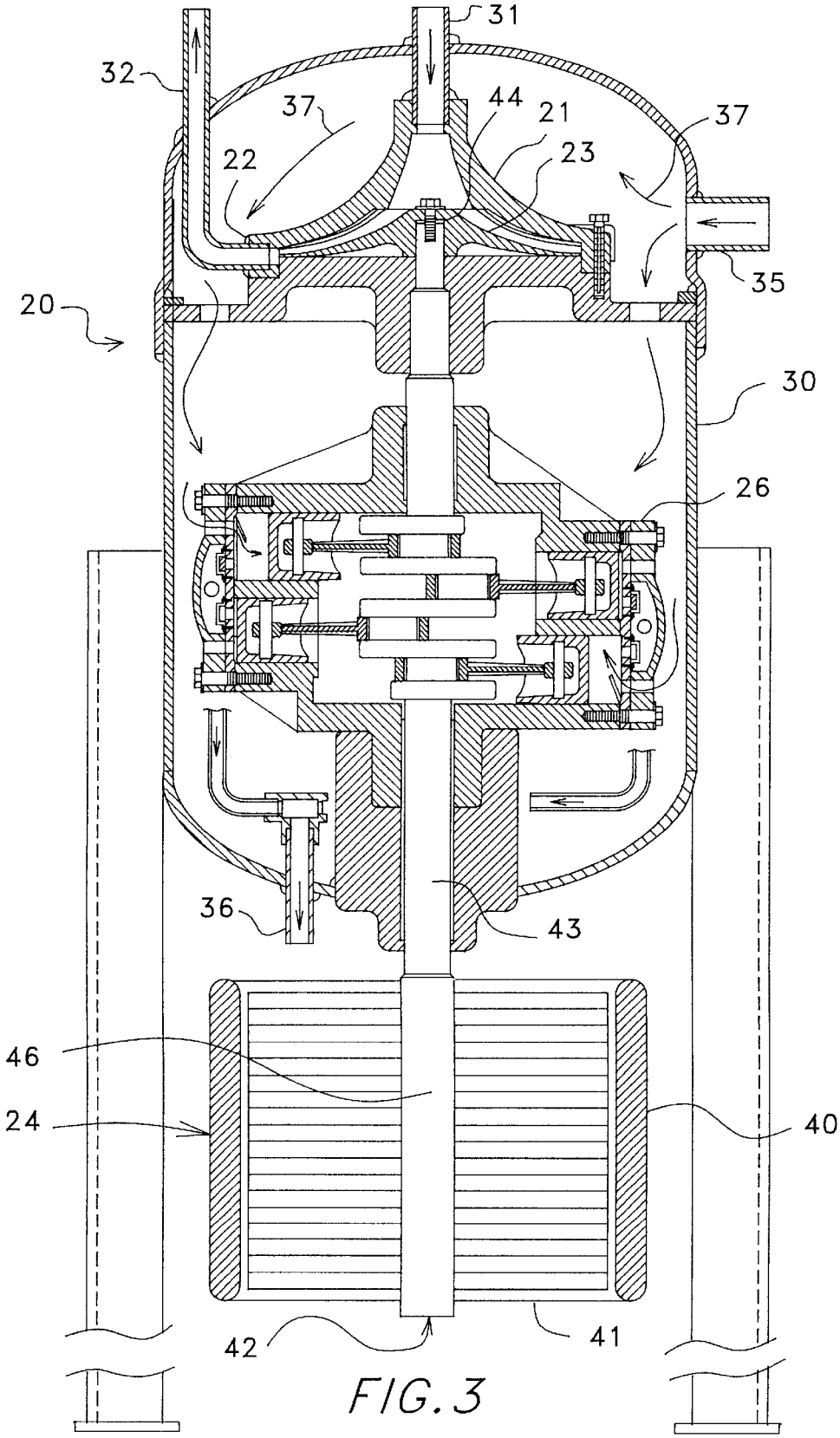
FIG. 3 is a cross-sectional view of an external drive device embodiment of a compressor-pump unit of FIG. 1.

Referring again to FIG. 2, the compressor-pump unit 20 includes a driving device 24 with a shaft 42 for concurrently operating the liquid pump 21 and the compressor 26. To achieve this concurrent operation, the shaft 42 of the driving device comprises three portions: a first portion 43 interconnected with the compressor 26, a second portion 44 coupled to rotating portions of the pump 21 (e.g., as illustrated, impeller 23), and a third portion 46 which is rotated within the driving device 24 at a speed selected for proper operation of both the liquid pump 21 and the compressor 26. To provide the desired shaft rotation, the driving device 24 may take many forms, including, for example, a belt drive system, a steam turbine, a fossil fuel engine, and an electric motor. As illustrated, the driving device 24 comprises an electric motor 40 with a rotor 41 rigidly coupled with the third portion 46 of the shaft 42. While the electric motor 40 is shown in FIG. 2 to be interposed between the pump 21 and the compressor 26, it should be understood that the driving device 24 may readily be positioned on one end of the shaft 42. For example, an embodiment of the present invention is shown in FIG. 3 in which the electric motor 40 is mounted on an end (third portion 46) of the shaft 42.

A magnetic coupling 25 can be positioned at the connection between the liquid pump 21 and the single shaft 42 to insure a proper seal and to inhibit liquid from leaking from the liquid pump 21. It should be noted that other types of seals to seal the single shaft 42 are within the scope of the present invention.

Several advantages are recognized by mounting the components of the compressor-pump unit 20 on a single shaft 42. A single driving device 24 can drive the liquid pump 21 and the compressor 26 to reduce initial costs and ongoing maintenance and operating costs. Additionally, the compressor-pump unit 20 may include a containment vessel or housing to enclose one or more components to increase the durability of the components, to effectively and inexpensively seal refrigerant within the refrigeration system 10, and to obtain desirable heat transfer between flowing refrigerant and compressor-pump unit 20 components, such as the liquid pump 21 and the driving device 24. In FIG. 2, the compressor-pump unit 20 includes a sealable housing 30 enclosing and supporting the liquid pump 21, the driving device 24, and the compressor 26. In another design according to the present invention, the compressor-pump unit 20 may include a sealable housing 30 that houses the liquid pump 21 and the compressor 26, as shown in FIG. 3. Further, a compressor-pump unit housing maybe configured to house a liquid pump and a driving device with a shaft interconnecting a separately housed compressor or be configured to house a compressor and a driving device with shaft interconnecting a separately housed liquid pump.

Referring again to FIG. 2, the housing 30 functions as a protective containment for the liquid pump 21, the driving device 24, and the compressor 26. This containment may be advantageously achieved with an overall vessel or containment size that is equivalent or slightly larger than currently utilized compressor and motor housings. Because many refrigeration systems are designed for applications with limited space, such as for automobiles, the improved size requirements of the present invention make the compressor-pump unit 20 readily applicable for retrofitting existing refrigeration systems and for systems that will be designed and built for restricted space applications.

Additionally, the housing 30 directs refrigerant flow and includes a refrigerant inlet 31 and a refrigerant outlet 32 for the liquid pump 21, and further includes a refrigerant inlet 35 and a refrigerant outlet 36 for the compressor 26. Liquid refrigerant from the condenser 18 flows through the refrigerant inlet 31 to the liquid pump 21 which inputs energy with impeller 23 and discharges the higher pressure, subcooled liquid refrigerant through a discharge port 22 and the refrigerant outlet 32. While a single-stage, centrifugal pump is illustrated, it should be understood that multistage, centrifugal pumps and other types of pumps, including rotary and reciprocating pumps, may be successfully utilized as part of the compressor-pump unit 20 of the present invention.

Figure 7:
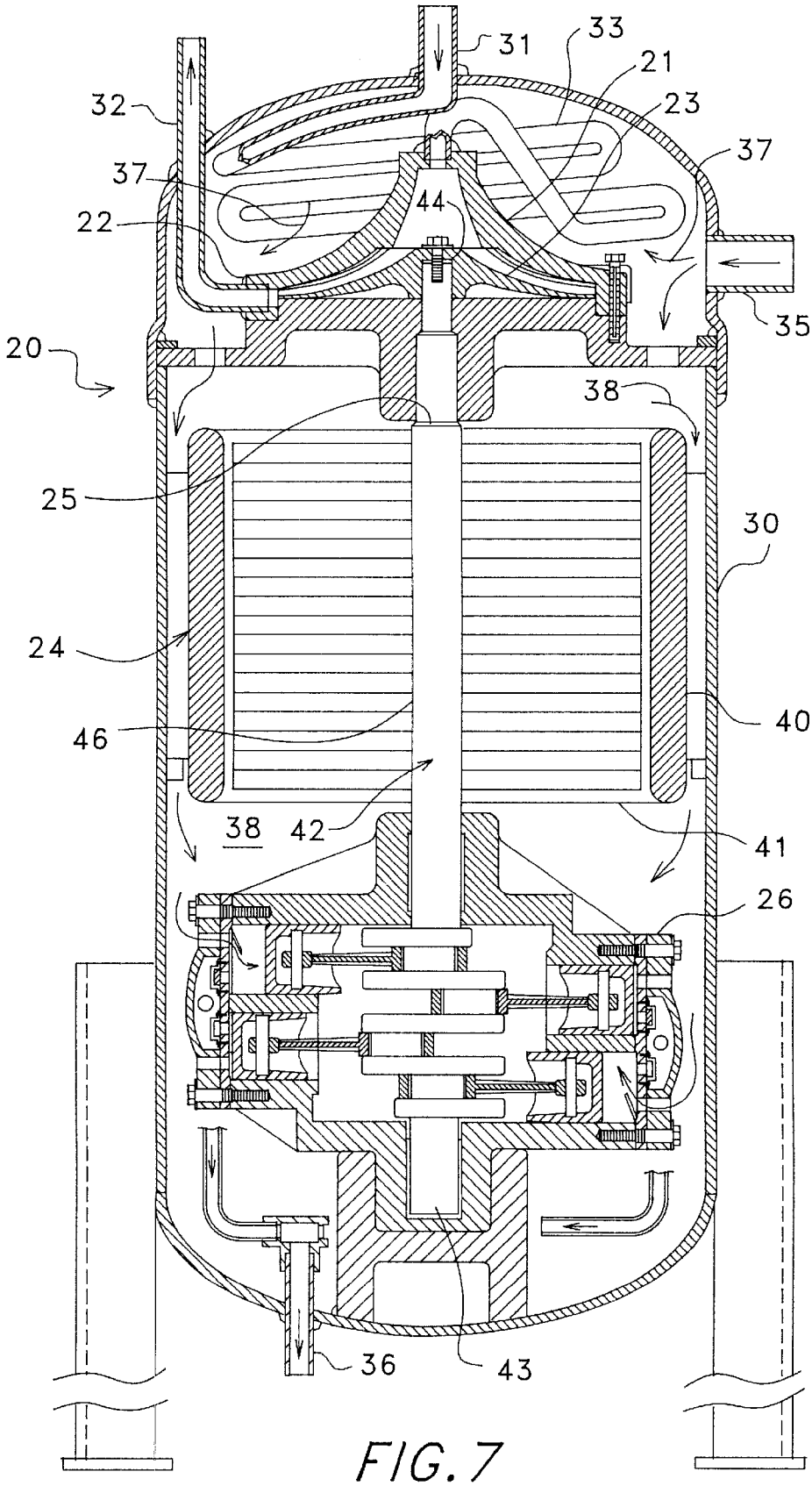
FIG. 7 is a cross-sectional view of the single housing embodiment of a compressor-pump unit of FIG. 1 illustrating a pre-cooling circuit in the cold vapor stream.

As illustrated in FIG. 7, the refrigeration system 10 further includes a pre-cooling circuit 33 connected between the refrigerant inlet 31 and the liquid pump 21 within the housing 30. The pre-cooling circuit 33 is exposed to the lower temperature refrigerant vapor flow 37 within the housing 30 thereby absorbing the higher temperature liquid and lowering the temperature of the liquid within the pre-cooling circuit 33 to a point below the saturation temperature of the liquid. The liquid then becomes pure liquid free from bubbles prior to entering the liquid pump 21 thereby inhibiting cavitation of the liquid pump 21.

Still referring to FIG. 7, in a first embodiment, the pre-cooling circuit 33 is a tube or series of wrapped tubes interconnected between the refrigerant inlet 31 and the liquid pump 21. The tube or tube is exposed to the lower temperature refrigerant vapor flow 37 to lower the temperature of the liquid within the pre-cooling circuit. Preferably, the tube or tubes of the pre-cooling circuit 33 are constructed from a steel or copper material although constructing the tube or tubes from a different material to promote heat transfer between the liquid and the lower temperature refrigerant vapor flow 37 is within the scope of the present invention.

In another embodiment, the pre-cooling circuit 33 is a double-wall defining an interstitial space between the liquid pump 21 and the lower temperature refrigerant flow 37 with the liquid flowing within the interstitial space between the liquid pump 21 and the lower temperature refrigerant vapor flow 37. Once again, it is preferable that the double-wall is constructed from a material, such as steel, copper, etc., which promotes heat transfer between the liquid and the lower temperature refrigerant vapor flow 37. It should be noted that while particular embodiments have been described herein, it is within the scope of the present invention for the pre-cooling circuit 33 to be any type of conduit or separated space through which the liquid can flow between the refrigerant inlet 31 and the liquid pump 21 to cool the liquid to a pure liquid phase thereby inhibiting cavitation within the liquid pump 21.

It should be noted that the pre-cooling circuit 33, in any of the embodiments, can be composed of transpiring material providing heat exchange by evaporation of liquid through a slightly porous material.

As discussed above, low temperature, low-pressure refrigerant vapor flows from the evaporator 14 to the compressor-pump unit 20. The refrigerant vapor enters through the refrigerant inlet 35 flows into the compressor 26 and is compressed to a higher pressure and higher temperature before being discharged out the refrigerant outlet 36 to flow to the condenser 18. As with the liquid pump 21, many types of shaft-driven compressors that may be utilized to successfully practice the compressor-pump unit 20 of the present invention. In this regard, the compressor 26 may be a reciprocating compressor as shown or may be, for example, a centrifugal, screw, or scroll compressor. Although not shown, the housing 30 may also be configured to house other support equipment, such as an oil cooler for the compressor 26.

Another important feature of the housing 30 of the compressor-pump unit 20 is that the housing 30 enables low temperature refrigerant vapor from the evaporator to be used to effectively cool the pump 21 and the driving device 24 prior to entering the compressor 26. The refrigerant vapor entering the housing 30 at the refrigerant inlet 35 will be at temperatures significantly lower than the liquid refrigerant within the pump 21. This large temperature differential enables heat to be transferred from the higher temperature liquid refrigerant to the lower temperature refrigerant vapor by passing the refrigerant vapor over the pump 21 and the pump refrigerant outlet 32. By reducing the temperature of the liquid refrigerant flowing from the housing 30 to the expansion device 12, the cooling potential of the refrigerant is increased because the liquid refrigerant is subcooled beyond the subcooling provided by the added pressure from the liquid pump 21. As will be understood by those skilled in the art, a variety of heat transfer methods may be utilized to achieve this desired additional subcooling. As illustrated, a pump cooling pathway 37 in the housing 30 is used to direct the lower temperature refrigerant vapor to flow over, and contact, the pump 21 and refrigerant outlet 32. This effectively results in heat being passed from the higher temperature liquid refrigerant within the pump 21 and refrigerant outlet 32 to the flowing lower temperature refrigerant vapor. Although not shown, alternative methods of heat transfer may include increasing the heat transfer area (e.g., varying the outer shape of the pump 21 and/or creating a path 37, such as a tube wrapped around the pump 21, that increases the contact area) and using cross-flow to maintain a higher temperature differential (i.e., lower temperature refrigerant vapor entering near a point the liquid refrigerant is exiting the housing 30). FIG. 3 illustrates how a pump cooling pathway 37 may be included in a housing 30 that houses a pump 21 and a compressor 26 with an external driving device 24. Referring again to FIG. 2, to cool the electric motor 40 of the driving device 24, the housing 30 includes a motor cooling pathway 38 to direct refrigerant vapor about the peripheral surfaces of the electric motor 40 to cool the electric motor 40 to a preferred operating temperature for an extended service life. In this manner, the use of one driving device 24 and shaft 42 enables the housing 30 to be uniquely designed to structurally support and contain the liquid pump 21, the driving device 24, and the compressor 26, and further, to effectively cool the driving device 24 and refrigerant within the liquid pump 21.

Additionally, the housing 30 may be designed to provide structural features of the housed components. In this regard, although not illustrated, the housing 30 may be configured to provide a pump casing for the liquid pump 21, a discharge manifold for the compressor, and other useful structures. To provide these structures, the housing 30, or a portion thereof, may be molded to contain the desired features or structures. For example, but not as a limitation, the housing 30 may be molded with a pump volute as one end portion and a compressor discharge manifold for a scroll compressor as the opposite end portion. As will be apparent to those skilled in the art, the specific molded design of the housing 30 may readily be adapted to match the specific compressor and pump types selected and the physical arrangement of these components within the housing.

Another significant aspect of the present invention is the injection of liquid refrigerant from a liquid pressure amplification pump into high temperature, high pressure refrigerant vapor at the compressor discharge, i.e., within the compressor discharge manifold or discharge line within the compressor housing. This use of the discharge of the liquid pressure amplification pump provides a vapor-compression refrigeration system in which refrigerant vapor at or near the saturation point (i.e., refrigerant vapor at substantially the compressor discharge pressure but at a lower temperature) is delivered to a condenser. Delivering saturated refrigerant vapor to a condenser inlet results in improved condenser efficiency as nearly all of the condenser volume may be used in removing heat to condense the refrigerant vapor to liquid rather than initially removing superheat simply to obtain a saturated vapor. Further, the condenser may be operated at a lower condensing temperature which is desirable to improve service life and heat transfer efficiency by controlling scale formation on condenser surfaces and surface degradation that occurs more rapidly at higher condensing temperatures.

As discussed above, the injection of the liquid refrigerant, and thus desuperheating, preferably occurs within the compressor discharge manifold or discharge line prior to the high temperature, high pressure refrigerant being discharged from the compressor housing or containment. This liquid injection location is important in reducing the operating temperature of the compressor, the compressor housing, and any included compressor discharge controls, such as discharge valves. Lower operating temperatures for these components are desirable for extending the service life of the compressor and the discharge valve. Additionally, external cooling, in the form of head cooling fans, water jackets, and the like, may not be required in applications that currently require cooling, such as refrigeration applications in which the compressor housing is positioned in an enclosed area or adjacent to temperature sensitive equipment. Therefore, use of the present invention may reduce design, equipment, and maintenance costs. Further cost and space savings may be realized because the reduction of the temperature within the compressor discharge manifold and housing may allow oil coolers, generally used with refrigeration system compressors, to be reduced in size and capacity.

Figure 4:
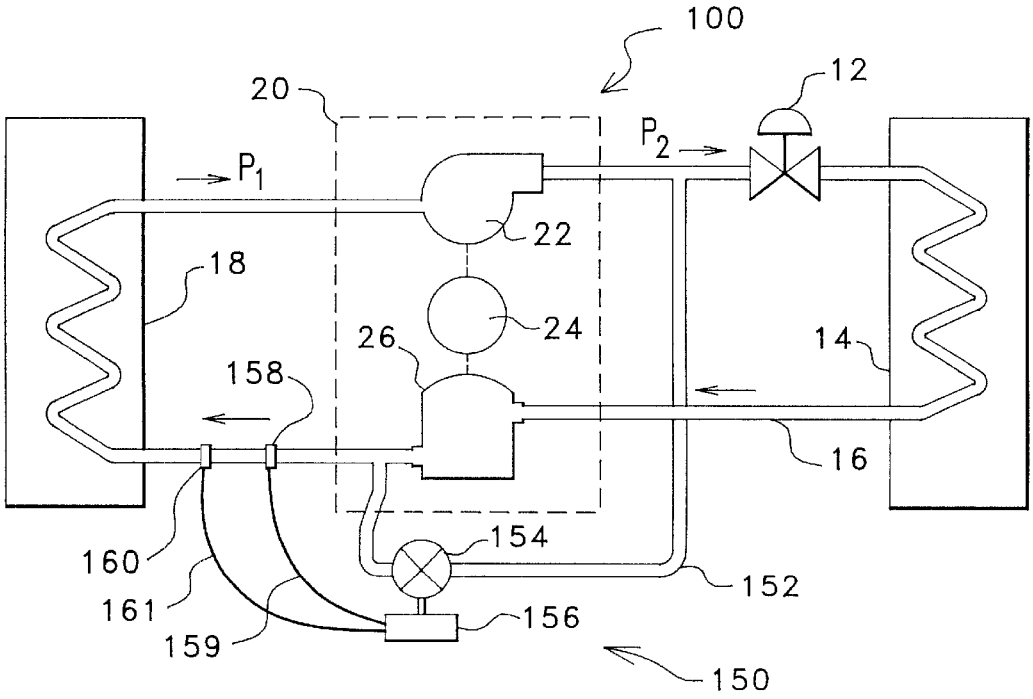
FIG. 4 is a schematic diagram of a vapor-compression refrigeration system utilizing desuperheating according to the present invention and including a liquid injection assembly.

FIG. 4 illustrates schematically a vapor-compression refrigeration system 100 including a liquid injection assembly 150 to desuperheat the compressor 26 discharges within the compressor 26 discharge pathway. The liquid injection assembly 150 may be relatively simple in design, containing only a liquid injection pipe section 152 because the liquid pump 22 discharge pressure, $P_2$, is the highest pressure in the refrigeration system 100, thus enabling injection of the higher pressure liquid refrigerant into the compressor 26 discharge pathway.

Figure 5:
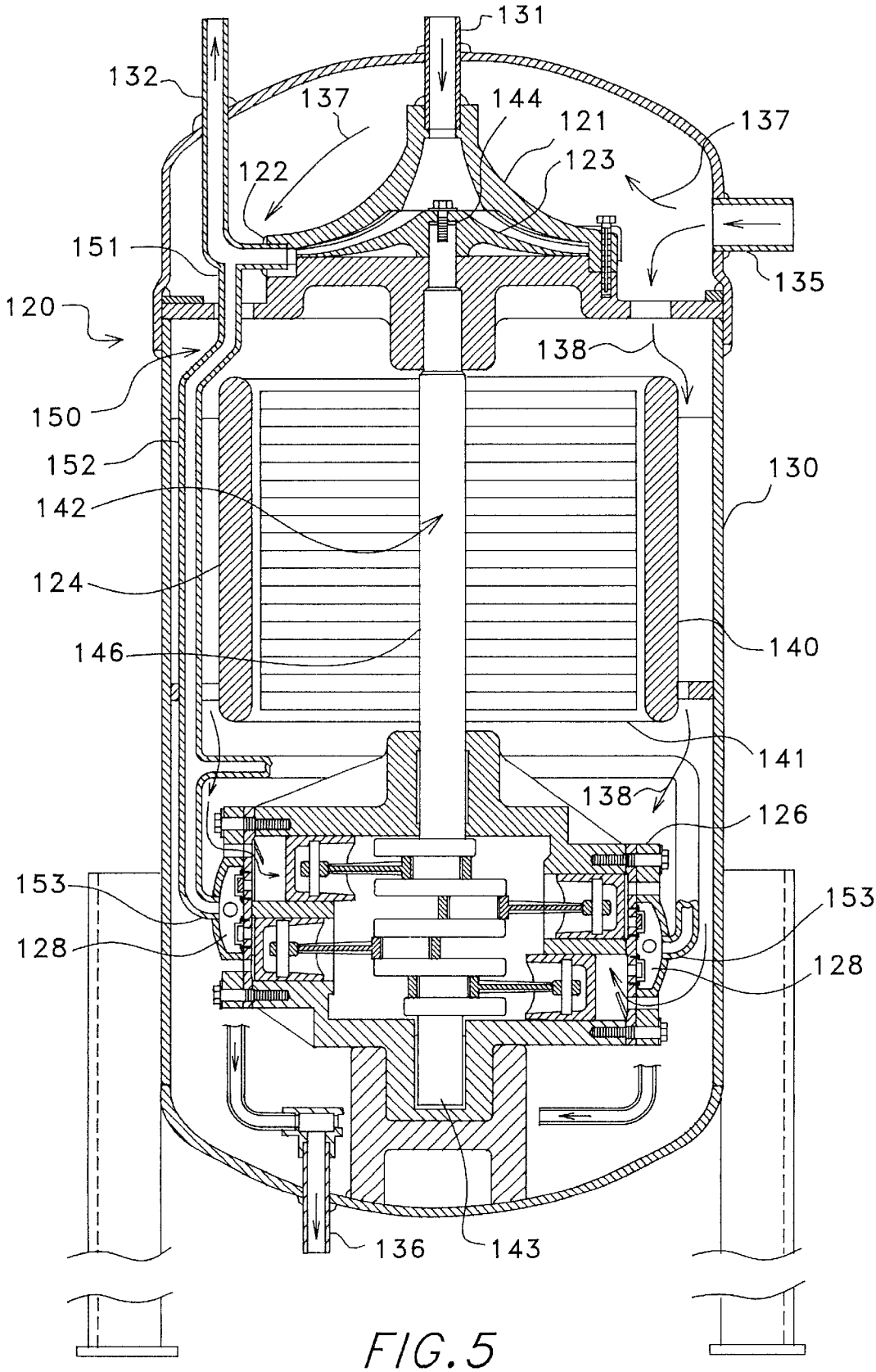
FIG. 5 is a cross-sectional view of a compressor-pump unit of FIG. 4 including a liquid injection assembly.

In this regard and referring to FIG. 5, a preferred embodiment of a compressor-pump unit 120 including a liquid injection assembly 150 is illustrated. The containment of the liquid injection assembly 150 within the housing 130 improves durability and also, provides a compressor-pump unit 120 with desuperheating that has similar external dimensions and appearance to existing compressor and motor vessels, which may facilitate placement of the compressor-pump unit 120 within existing refrigeration systems and within systems yet to be fabricated. The liquid injection pipe section 152 has an inlet 151 downstream from the outlet port 122 of the liquid pump 121 within the housing 130. Liquid refrigerant flows from the inlet 151 through the liquid injection pipe section 152 to outlets 153 located in a discharge pathway 128 of compressor 126. The volume of refrigerant flow is controlled by selecting an inner diameter for the liquid injection pipe section 152 based, at least in part, upon anticipated operating pressures and a calculated pressure differential between the liquid pump 121 and the compressor 126, operating system and external temperatures, and expected refrigerants for the compressor-pump unit 120. The specific location and number of outlets 153 may be varied to desuperheat compressor discharges and to cool the compressor 126 and will depend upon the compressor types used. Similarly, the outlets 153 may be located in a discharge manifold or discharge piping to achieve many of the benefits of the present invention.

As will be clear to those skilled in the art, it may be preferable that liquid injection assembly 150 be operable to actively monitor and control whether a proper volume of liquid refrigerant is injected to desuperheat refrigerant vapor being fed to condenser 18. This may be desirable to account for varying operating conditions, such as changes in external temperatures, and to account for operating ranges of included refrigeration equipment. Because each vapor, here refrigerant vapor, has a saturation temperature corresponding to each pressure, the measurement of the pressure and/or the temperature of the refrigerant vapor after injection of the lower temperature, liquid refrigerant and also at, or before, the condenser 18 inlet enables the maintenance of the refrigerant vapor at or near saturation through desuperheating by injecting a volume of liquid refrigerant to match sensed refrigerant temperature (i.e., actual refrigerant temperature) to a saturated temperature value corresponding to a sensed refrigerant pressure.

Figure 6:
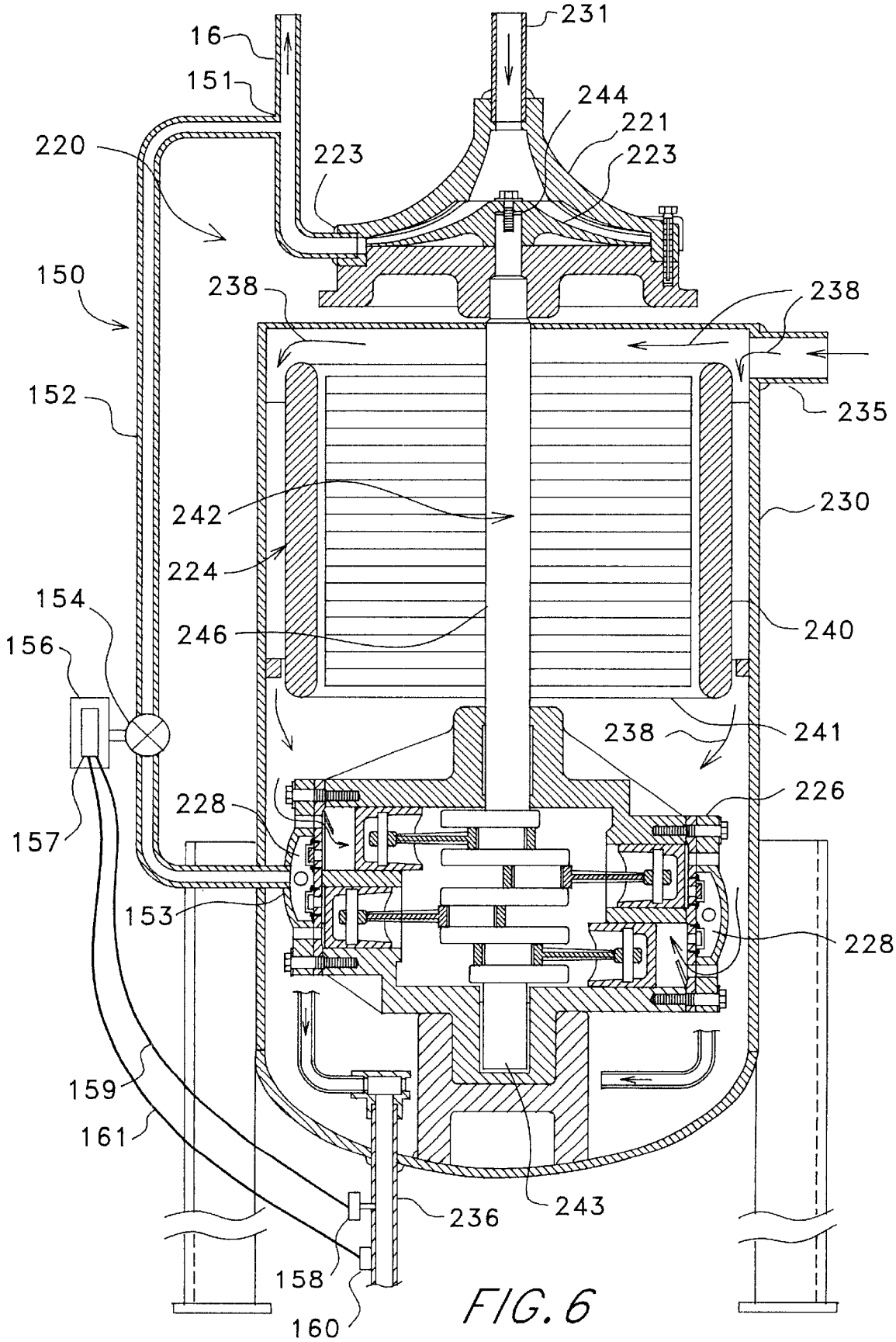
FIG. 6 is a cross-sectional view of a compressor-pump unit of FIG. 4 showing separate pump and compressor housings and a liquid injection assembly.

In this regard, a simple feedback controller may be employed to operate a valve in the liquid injection pipe section 152 based on pressure signals and/or temperature signals received from sensors positioned downstream of the liquid refrigerant injection point and from sensors positioned further downstream or near the condenser 18. Referring to FIGS. 4 and 6, liquid injection assembly 150 includes a control valve 154 in the liquid injection pipe section that is operated by a feedback controller 156 to control or meter the volume of lower temperature, liquid refrigerant that flow through the liquid injection pipe section 152. FIG. 6 illustrates a compressor-pump unit 220 in which a liquid pump 221 is housed separately from compressor 226 and driving device 224, both of which are housed within housing 230. Driving device 224 includes a shaft 242 for driving both the liquid pump 221 and the compressor 226 concurrently.

Although every combination of a pump, a compressor, and a driving device(s) is not shown, it should be understood that the liquid injection assembly 150 illustrated in FIG. 6 may be successfully implemented in any refrigeration system which includes a liquid pressure amplification pump and a compressor, whether or not a single driving device is utilized. Referring again to FIG. 6, lower temperature, higher pressure liquid refrigerant enters the liquid injection pipe section 152 at inlet 151 downstream of outlet port 223 of liquid pump 221 and on refrigerant piping 16. The liquid refrigerant flows through control valve 154 to outlet 153 of the liquid injection pipe section 152. The liquid injection pipe section 152, or at least the outlet 153, sealably penetrates the housing 230 to enable the liquid refrigerant to be injected within the compressor discharge pathway 228. Although shown in FIG. 6 as a portion of the compressor 226, the compressor discharge pathway 228 may comprise any flow path for the discharged refrigerant gas between an outlet port (i.e., downstream from discharge valves of a compressor) on the compressor 226 and the refrigerant outlet 236 in the housing 230. To provide cooling to the compressor 226, it may be preferable that the outlet 153 be positioned relatively near to the compressor 226 outlet port(s) with specific location depending upon the type of compressor utilized and the specific configuration of the containing vessel used to house the compressor. To illustrate, many compressor vessel designs include threaded connections near the compressor discharge which may be successfully utilized as an inlet for liquid injection.

The liquid injection assembly 150 includes feedback controller 156 that is communicatively linked by signal lines 159 and 161, respectively, to pressure sensor 158 and temperature sensor 160. Pressure sensor 158 may be positioned at any location between the outlet 153 of the liquid injection pipe section 152 and the condenser 18 inlet. The pressure sensor 158 operates to detect the pressure of the refrigerant vapor after the desuperheating liquid refrigerant has been injected into and mixed with the refrigerant vapor discharged from the compressor 226. The pressure sensor 158 then transmits a corresponding signal via signal line 159 to the feedback controller 156. The temperature sensor 160 similarly may be positioned at a number of locations downstream from the refrigerant outlet 236 in the housing 230 to sense refrigerant vapor temperature and transmit a corresponding signal via signal line 161 to the feedback controller 156. Preferably, the temperature sensor 160 may be positioned near the condenser 18 inlet to sense the temperature of refrigerant vapor entering the condenser 18. The feedback controller 156 then compares the received temperature signal from the temperature sensor 160 to a saturation temperature for the refrigerant corresponding to the pressure signal received from the pressure sensor 158. The feedback controller 156 then operates the control valve 154 as appropriate to change the temperature of the refrigerant vapor to the saturation temperature corresponding to pressure sensed by pressure sensor 158, and in this manner, the refrigerant vapor is maintained at or near saturation as it enters the condenser 18 improving the efficiency of the condenser 18 over a wide range of condensing, i.e., compressor outlet, pressures. Feedback controller devices, temperature sensors, and pressure sensors are well-known in the refrigeration industry, and this generally known equipment may be employed to successfully practice the present invention.

Additionally, the feedback controller 156 may contain a microprocessor 157 to allow effective control of the control valve 154 and monitoring of the liquid injection assembly 150 operation. The microprocessor 157 preferably includes a memory for storing saturation pressures and corresponding saturation temperatures for at least one refrigerant, and more preferably for all refrigerants which are anticipated to be used in connection with the liquid injection assembly 150. With these values in memory, the microprocessor 157 preferably is configured to enable a user to input via a menu on a monitor (not shown) or switching device (not shown) the refrigerant that is utilized in the refrigeration system 100 in which the liquid injection assembly 150 is installed. This switching-memory feature facilitates the use of the liquid injection assembly 150 of the present invention with any standard refrigerant without requiring programming or adaptation for each refrigerant or system. In operation, the microprocessor 157 receives a pressure signal from the pressure sensor 158 via signal line 159. The microprocessor 157 uses this pressure signal to retrieve a saturation temperature based on a user input refrigerant. A temperature signal is then received by the microprocessor 157 from the temperature sensor 160 via signal line 161. The microprocessor 157 compares the received temperature signal to the retrieved saturation temperature and signals the feedback controller 156 to operate the control valve 154 to throttle open or close, such that liquid refrigerant flow into the compressor discharge pathway 228 desuperheats the refrigerant vapor to saturation. This monitoring operation may be repeated at predetermined periods of time to account for changing operating conditions, with the period of time being adjustable based on the particular refrigeration application, for example, short periods (e.g., nearly continuous adjustment/throttling of control valve 154) for refrigeration systems that experience more rapid changes in operating temperatures and/or pressures.

The foregoing description is considered as illustrative only of the principles of the invention. Furthermore, since numerous modifications and changes will readily occur to those skilled in the art, it is not desired to limit the invention to the exact construction and process shown and described above. Accordingly, resort may be made to all suitable modifications and equivalents that fall within the scope of the invention as defined by the claims which follow.

The embodiment of the invention in which an exclusive property or privilege is claimed are defined as follows:

1. A compressor-pump unit for use in a vapor-compression refrigeration system, the compressor-pump unit comprising:

a driving device including a rotatable shaft;

a compressor, coupled with a first portion of the shaft, for compressing gaseous refrigerant within the vapor-compression refrigeration system;

a liquid pump, coupled with a second portion of the shaft, for receiving liquid refrigerant having a first pressure and for discharging the received liquid refrigerant at a second pressure, the second pressure being higher than the first pressure by a predetermined amount such that the discharged liquid refrigerant is subcooled; and a sealable housing having a first refrigerant inlet and a first refrigerant outlet connected to the compressor and a second refrigerant inlet and a second refrigerant outlet connected to the pump, the housing further having a pump cooling, refrigerant pathway for directing the gaseous refrigerant between the first refrigerant outlet and the compressor such that the gaseous refrigerant flows over and contacts a pump casing of the pump;

wherein the first and second portions of the shaft, the compressor, and the pump are supported within the sealable housing;

whereby the gaseous refrigerant absorbs heat from the liquid refrigerant, through the pump casing, prior to the liquid refrigerant being discharged from the pump.

2. The compressor-pump unit of claim 1, wherein the liquid refrigerant has a temperature at or below the saturation temperature of the liquid refrigerant prior to entering the liquid pump.

3. The compressor-pump unit of claim 1, wherein the pump is a centrifugal pump having an impeller coupled to the second portion of the shaft and further, wherein the housing includes a compressor end portion being configured to form the pump casing for the pump, the pump casing including a pump volute, the refrigerant inlet for the pump, and the refrigerant outlet for the pump.

4. The compressor-pump unit of claim 1, wherein the shaft of the driving device has a third portion external to the housing.

5. The compressor-pump unit of claim 4, wherein the driving device includes a belt assembly external to the housing and coupled to the third portion of the shaft to rotate the first and the second portions of the shaft.

6. The compressor-pump unit of claim 4, wherein the driving device includes an electric motor coupled to the third portion of the shaft to rotate the first and the second portions of the shaft.

7. The compressor-pump unit of claim 1, wherein the driving device includes an electric motor having a rotor coupled with a third portion of the shaft to rotate the first and the second portions of the shaft, the electric motor being disposed within the housing.

8. The compressor-pump unit of claim 7, wherein the compressor has a discharge pathway for transmitting compressed gaseous refrigerant from the compressor to the compressor refrigerant outlet of the housing and wherein the compressor-pump unit further includes a liquid injection pipe having an inlet on the pump refrigerant outlet of the housing and an outlet on the discharge pathway of the compressor, the liquid injection pipe being wholly contained within the housing.

9. The compressor-pump unit of claim 7, wherein the electric motor is interposed between the compressor and the pump.

10. The compressor-pump unit of claim 9, wherein the housing includes a pump cooling, refrigerant pathway for directing the gaseous refrigerant between the refrigerant inlet in the housing for the compressor and the compressor such that the gaseous refrigerant flows over and contacts a pump casing of the pump, whereby the gaseous refrigerant absorbs heat from the liquid refrigerant, through the pump casing, prior to the liquid refrigerant being discharged from the pump.

11. The compressor-pump unit of claim 9, the housing including a motor-cooling, refrigerant pathway for directing the gaseous refrigerant between the refrigerant inlet in the housing for the compressor and the compressor, wherein the electric motor is positioned within the motor cooling pathway to be cooled through contact with the gaseous refrigerant.

12. A combined refrigeration unit having a refrigeration compressor for compressing gaseous refrigerant and a liquid refrigerant pump for receiving and discharging a liquid refrigerant, the combined refrigeration system comprising:

a liquid pre-cooling heat exchanger circuit connected to the liquid refrigerant pump and exposed to the gaseous refrigerant, the gaseous refrigerant absorbing heat from the liquid refrigerant within the liquid pre-cooling heat exchanger circuit, prior to the liquid refrigerant entering the liquid pump, wherein the pre-cooling heat exchanger circuit is a tube.

13. The combined refrigeration unit of claim 12 wherein the liquid refrigerant has a temperature at or below the saturation temperature of the liquid refrigerant prior to entering the liquid pump.

14. A method of enhancing the operational efficiency of a combined refrigeration system having a refrigeration compressor for compressing gaseous refrigerant and a liquid refrigerant pump for receiving and discharging a liquid refrigerant, the method comprising the steps of:

exposing the liquid refrigerant within a pre-cooling circuit to the gaseous refrigerant prior to the liquid refrigerant entering the liquid pump;

enclosing the refrigeration compressor and the liquid refrigerant pump within a sealable housing;

providing the pre-cooling circuit within the housing, the liquid refrigerant flowing through the pre-cooling circuit; and exposing the pre-cooling circuit to the gaseous refrigerant.

15. The method of claim 14, and further comprising:

lowering the temperature of the liquid refrigerant to a temperature at or below the saturation temperature of the liquid refrigerant prior to entering the liquid pump.

16. The method of claim 14, wherein the pre-cooling circuit is a tube.

17. The method of claim 14 wherein the pre-cooling circuit is a space defined between the gaseous refrigeration and the liquid pump.

18. A compressor-pump unit for use in a vapor-compression refrigeration system, the compressor-pump unit comprising:

a driving device including a rotatable shaft;

a compressor, coupled with a first portion of the shaft, for compressing gaseous refrigerant within the vapor-compression refrigeration system;

a liquid pump, coupled with a second portion of the shaft, for receiving liquid refrigerant having a first pressure and for discharging the received liquid refrigerant at a second pressure, the second pressure being higher than the first pressure by a predetermined amount such that the discharged liquid refrigerant is subcooled; and a pre-cooling circuit connected to the liquid pump, the pre-cooling circuit being exposed to the gaseous refrigerant whereby the gaseous refrigerant absorbs heat from the liquid refrigerant, prior to the liquid refrigerant entering the liquid pump, wherein the pre-cooling circuit is a tube.

19. A compressor-pump unit for use in a vapor-compression refrigeration system, the compressor-pump unit comprising:

a driving device including a rotatable shaft;

a compressor, coupled with a first portion of the shaft, for compressing gaseous refrigerant within the vapor-compression refrigeration system;

a liquid pump, coupled with a second portion of the shaft, for receiving liquid refrigerant having a first pressure and for discharging the received liquid refrigerant at a second pressure, the second pressure being higher than the first pressure by a predetermined amount such that the discharged liquid refrigerant is subcooled; and a pre-cooling circuit connected to the liquid pump, the pre-cooling circuit being exposed to the gaseous refrigerant whereby the gaseous refrigerant absorbs heat from the liquid refrigerant, prior to the liquid refrigerant entering the liquid pump, wherein the pre-cooling circuit is an interstitial space defined between the gaseous refrigeration and the liquid pump.

20. The compressor-pump unit of claim 19, further including a sealable housing within which the first and second portions of the shaft, the compressor, the pump, and the pre-cooling circuit are supported, wherein the housing includes a refrigerant inlet and a refrigerant outlet for the compressor and a refrigerant inlet and a refrigerant outlet for the pump.

21. The compressor-pump unit of claim 20, wherein the shaft of the driving device has a third portion external to the housing and wherein the driving device includes a belt assembly external to the housing and coupled to the third portion of the shaft to rotate the first and the portions of the shaft.

22. The compressor-pump unit of claim 20, wherein the shaft of the driving device has a third portion external to the housing and wherein the driving device includes an electric motor coupled to the third portion of the shaft to rotate the first and the second portions of the shaft.

23. The compressor-pump unit of claim 20, wherein the pump is a centrifugal pump having an impeller coupled to the second portion of the shaft and further, wherein the housing includes a compressor end portion being configured to form the pump casing for the pump, the pump casing including a pump volute, the refrigerant inlet for the pump, and the refrigerant outlet for the pump.

* * * * *